US006354585B1

(12) United States Patent
Takahashi

(10) Patent No.: US 6,354,585 B1
(45) Date of Patent: Mar. 12, 2002

(54) IMAGE FORMING APPARATUS AND SHEET FEEDER FOR THE SAME

(75) Inventor: Yasuhiro Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 09/586,788

(22) Filed: Jun. 5, 2000

(30) Foreign Application Priority Data

Jun. 4, 1999 (JP) ..... 11-158007
Jul. 1, 1999 (JP) ..... 11-187127

(51) Int. Cl.[7] ..... B65H 3/44
(52) U.S. Cl. ..... 271/97
(58) Field of Search ..... 271/157, 162, 271/171, 97, 98; 399/372, 389, 393

(56) References Cited

U.S. PATENT DOCUMENTS 5,110,110 A * 5/1992 Wirz et al. ..... 271/98
5,259,606 A 11/1993 Takahashi

FOREIGN PATENT DOCUMENTS

EP 0 448 090 A2 * 9/1991 ..... B65H/3/12
JP 1-117139 * 1/1989 ..... B65H/3/12
JP 3-211136 * 1/1989 ..... B65H/3/12
JP 7-333917 12/1995
JP 10-017167 1/1998
JP 10-035927 2/1998

* cited by examiner

*Primary Examiner*—David H. Bollinger
*Assistant Examiner*—Kenneth W. Bower
(74) *Attorney, Agent, or Firm*—Oblon, Spivak, McClelland, Maier & Neustadt, P.C.

(57) ABSTRACT

A sheet feeder for sequentially feeding paper sheets one by one from a tray toward a preselected position, the top paper sheet being first, and an image forming apparatus including the same are disclosed. A friction roller device conveys, among the paper sheets stacked on the tray, upper paper sheets including the top paper sheet toward a separating device. A loosening device faces the leading edges of the paper sheets in the direction of sheet feed for loosing the sheets by sending air toward the leading edges. The top paper sheet on the tray is movable between a feeding position where the friction roller device is capable of conveying the top paper sheet and a loosening position where the loosening device faces the leading edges of the paper sheets.

11 Claims, 7 Drawing Sheets

IMAGE FORMING APPARATUS AND SHEET FEEDER FOR THE SAME

BACKGROUND OF THE INVENTION

The present invention relates to a copier, facsimile apparatus, printer or similar image forming apparatus. More particularly, the present invention relates to a sheet feeder included in an image forming apparatus for sequentially conveying sheets one by one from a tray toward a preselected position, the top sheet being first.

Generally, a sheet feeder for an image forming apparatus includes a tray loaded with a stack of sheets and a pickup roller for paying out the top sheet from the tray. A feed roller is positioned downstream of the pickup roller in the direction of sheet feed for feeding the sheet paid out toward a registration roller pair.

The sheet feeder is operable with plain paper sheets, coated paper sheets and so forth, as desired. Coated paper sheets have smooth surfaces and are permeable to air and hygroscopic. Therefore, in a humid environment, a greater adhering force acts between coated paper sheets than between plain paper sheets and degrades the feed of coated paper sheets. Specifically, the sheet feeder is apt to feed two or more coated paper sheets at the same time. The optimal solution to this problem is sucker type of air sheet feed customary with, e.g., a printer. However, this type of sheet feed is not feasible for an image forming apparatus for office use from the size, cost, noise and power consumption standpoint. In addition the sucker type of sheet feed needs sophisticated control over air. While suction box type of air sheet feed may be substituted for the sucker type of air sheet feed, the former is inferior to the latter as to separating ability and high-speed sheet feed although producing less noise than the latter.

It is a common practice with the sheet feeder to use loosening means for loosening, when the pickup roller pays out two or more paper sheets at the same time, separating one paper sheet from the other paper sheets and conveying it to the downstream side. Typical of the loosening means is a separator roller or a friction pad contacting the feed roller. When two or more paper sheets are paid out together, the separator roller rotates in the reverse direct ion to separate one paper sheet from the other paper sheets. Another conventional loosening means is a blower that sends air for loosening a stack of paper sheets. Even such conventional loosening means fail to obviate the simultaneous feed of multiple paper sheets when it comes to, e.g., coated paper sheets.

Technologies relating to the present invention are disclosed in, e.g., Japanese Patent Laid-Open Publication Nos. 7-333917, 10-17167, and 10-35927.

SUMMARY OF THE INVENTION

It is therefore an object of the present invention to provide a sheet feeder implementing sure sheet separation and high-speed sheet feed with a simple configuration including means for reducing an adhering force to act between paper sheets, and an image forming apparatus including the same.

It is another object of the present invention to provide a sheet feeder capable of surely and efficiently loosening paper sheets with a blower constructed to send air at an adequate timing, and an forming apparatus including the same.

In accordance with the present invention, a sheet feeder for sequentially feeding paper sheets stacked on a tray one by one toward a preselected position while separating them with a separating device includes a friction roller device for conveying, among the paper sheets stacked on the tray, upper paper sheets including the top paper sheet toward the separating device. A loosening devices faces the leading edges of the paper sheets in a direction of sheet feed for loosing the paper sheets by sending air toward the leading edges. The top paper sheet on the tray is movable between a feeding position where the friction roller device is capable of conveying the top paper sheet and a loosening position where the loosening device faces the leading edges of the paper sheets.

An image forming apparatus of the present invention includes an image forming section for transferring a toner image to a paper sheet fed from a sheet feeder having the above construction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
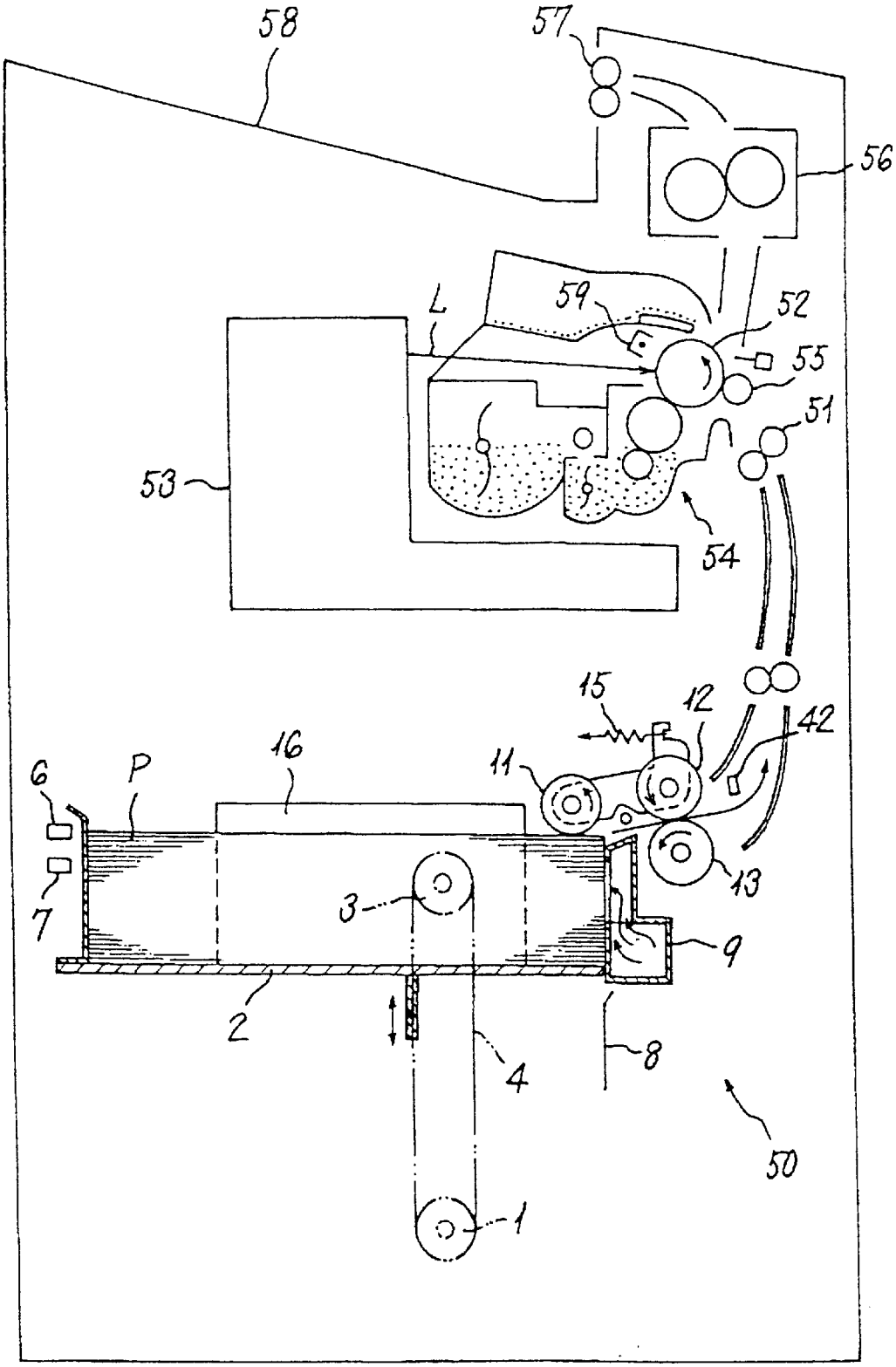
FIG. 1 is a view showing an image forming apparatus including a sheet feeder embodying the present invention.

Referring to FIG. 1 of the drawings, an image forming apparatus including a sheet feeder embodying the present invention is shown. While the image forming apparatus may be implemented as any one of a facsimile apparatus, a printer, a copier and so forth, the illustrative embodiment concentrates on a copier by way of example. All of such image forming apparatuses include an image forming section for transferring a toner image to a paper sheet fed from a sheet feeder by using an image carrier, image transferring means, and so forth. Paper sheets for the image forming apparatuses may be implemented by plain paper sheets or coated paper sheets, as desired.

As shown in FIG. 1, the copier includes a sheet feeder generally designated by the reference numeral 50. On receiving a sheet feed signal from a controller, not shown, the sheet feeder 50 pays out a single paper sheet P of a large size while separating it from the other sheets P. The paper sheet P reaches a registration roller pair 51 via guides and conveyor rollers arranged along a path extending in the up-and-down direction. The registration roller pair 51 once stops the paper sheet P and then drives it toward a photoconductive element 52 at a preselected timing that will be described later specifically. In the illustrative embodiment, the photoconductive element is implemented by a drum by way of example.

An image forming process to be executed by the illustrative embodiment will be described hereinafter. While the drum 52 is rotated counterclockwise, as viewed in FIG. 1, a charger 59 uniformly charges the surface of the drum 52. A laser beam L issuing from laser optics 53 scans the charged surfaces of the drum 52 to thereby electrostatically form a latent image on the drum 52.

A developing unit 54 develops the latent image formed on the drum 52 and thereby produces a corresponding toner image. The drum 52 in rotation further conveys the toner image toward a transfer roller or image transferring means 55. The registration roller 51 conveys the paper sheet P such that the leading edge of the paper sheet P meets the leading edge of the toner image at the transfer roller 55.

While the paper sheet P is conveyed via the transfer roller 55, the toner image is transferred from the drum 52 to the paper sheet P. The paper sheet P with the toner image is separated from the drum 52 due to the curvature of the drum 52 and conveyed upward. A fixing unit 56 fixes the toner image on the paper sheet P. Thereafter, the paper sheet or copy P is driven out to a copy tray 58 via an outlet roller 57.

The sheet feeder 50 will be described in detail with reference to FIGS. 1 through 3. As shown, the sheet feeder 50 includes a tray 2 on which the paper sheets P are stacked. Guide means, not shown, allows the tray 2 to slidingly move up and down. The tray 2 has a width in the direction perpendicular to the sheet surfaces of FIGS. 1 through 3. The body of the copier includes two sidewalls, or stationary members, facing each other in the direction of width of the tray 2 at opposite sides of the tray 2.

Let the top paper sheet P and some paper sheets P underlying it be referred to as upper paper sheets P hereinafter. At least at the time of sheet feed, a pickup roller or friction roller means 11 contacts the top paper sheet P. The pickup roller 11 is rotated to pay out the upper paper sheets P toward sheet separating means due to friction acting between the upper paper sheets P.

The sheet separating means is implemented by a feed roller 12 and a separator roller 13 provided in a pair at a position downstream of the pickup roller 11 in the direction of sheet feed. The upper paper sheets P paid out from the tray 2 are brought to a nip between the feed roller 12 and the separator roller 13.

A driveline, not shown, using gears connects the pickup roller 11, feed roller 12 and separator roller 13 such that the feed roller 12 serves as a drive source and causes the pickup roller 11 and separator roller 13 to rotate in synchronism therewith. During sheet feed, the pickup roller 11, feed roller 12 and separator roller 13 are rotated clockwise, as viewed in FIGS. 1 through 3.

The feed roller 12 and pickup roller 13 constitute conventional separating means using the principle of friction separation. Specifically, the feed roller 12 and pickup roller 13 cooperate to separate the top paper sheet P from the underlying paper sheets P on the basis of a difference in the coefficient of friction between the rollers 12 and 13. The top paper sheet P is then conveyed to an image transfer position between the drum 52 and the transfer roller 55, FIG. 1.

When a sensor 42 senses the leading edge of the paper sheet P being conveyed by the sheet separating means, it sends sense information to control means 41. The control means 41 forms part of a control unit that controls the entire process of the copier. In response to the sense information, the control means 41 lowers the tray 2 in order to loosen the paper sheets P, as will be described specifically later.

An arm 14 supports the pickup roller 11 at its free end. The pickup roller 11 is formed of a high friction material, rubber in the illustrative embodiment. The other end of the arm 14 is angularly movably mounted on a shaft 12*a* journalled to the previously mentioned sidewalls of the copier body. A tension spring 15 constantly biases part of the support arm 14 such that the support arm 14 tends to rotate counterclockwise about the shaft 12*a*.

Figure 2:
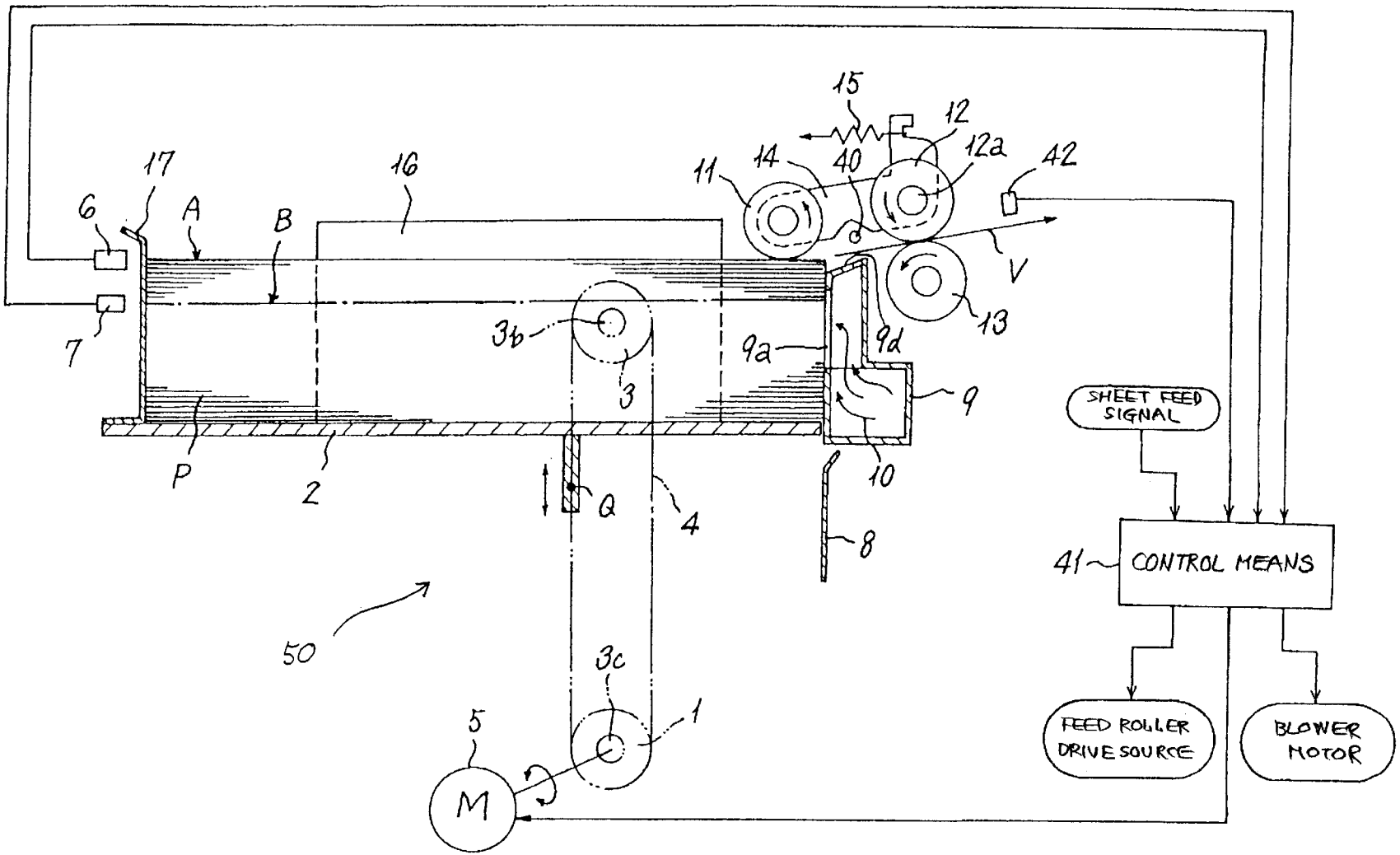
FIGS. 2 and 3 are fragmentary views showing the sheet feeder of FIG. 1 in detail.

As shown in FIG. 2, so long as the pickup roller 11 remains in contact with the top paper sheet P on the tray 2 being lowered, it limits the rotation of the arm 14 that is biased by the tension spring 15. As shown in FIG. 3, when the tray 2 is further lowered, it abuts against a stop 40 and is stopped thereby. The feed roller 12 is affixed to the shaft 12*a* and pressed against the separator roller 13. The separator roller 13 is journalled to the sidewalls.

Two shafts 3*b* (only one is visible) are respectively affixed to the opposite sidewalls while facing each other, and each protrudes to the outside of the associated sidewall. A pulley 3 is mounted on the protruding portion of each shaft 3*b* positioned outside of the respective sidewall. Two pulleys (only one is visible) 1 are respectively positioned beneath the shafts 3*b* and identical in diameter with the pulleys 3. The pulleys 1 are affixed to a single shaft 3*c* extending throughout the sidewalls. A reversible motor 5 has an output shaft connected to an extension of the shaft 3*c*.

A belt 4 is passed over the pulleys 3 and 1 positioned outside of one of the opposite sidewalls. Another belt 4 is passed over the pulleys 3 and 1 positioned outside of the other opposite sidewalls. The belts 4 each are affixed to part of the tray 2 at a position Q thereof.

In the above-described construction, when the motor 5 is driven, it causes the tray 2 to move upward or downward. For example, the motor 5 causes the tray 2 to move upward when driven in the forward direction or causes it to move downward when driven in the reverse direction.

Figure 3:
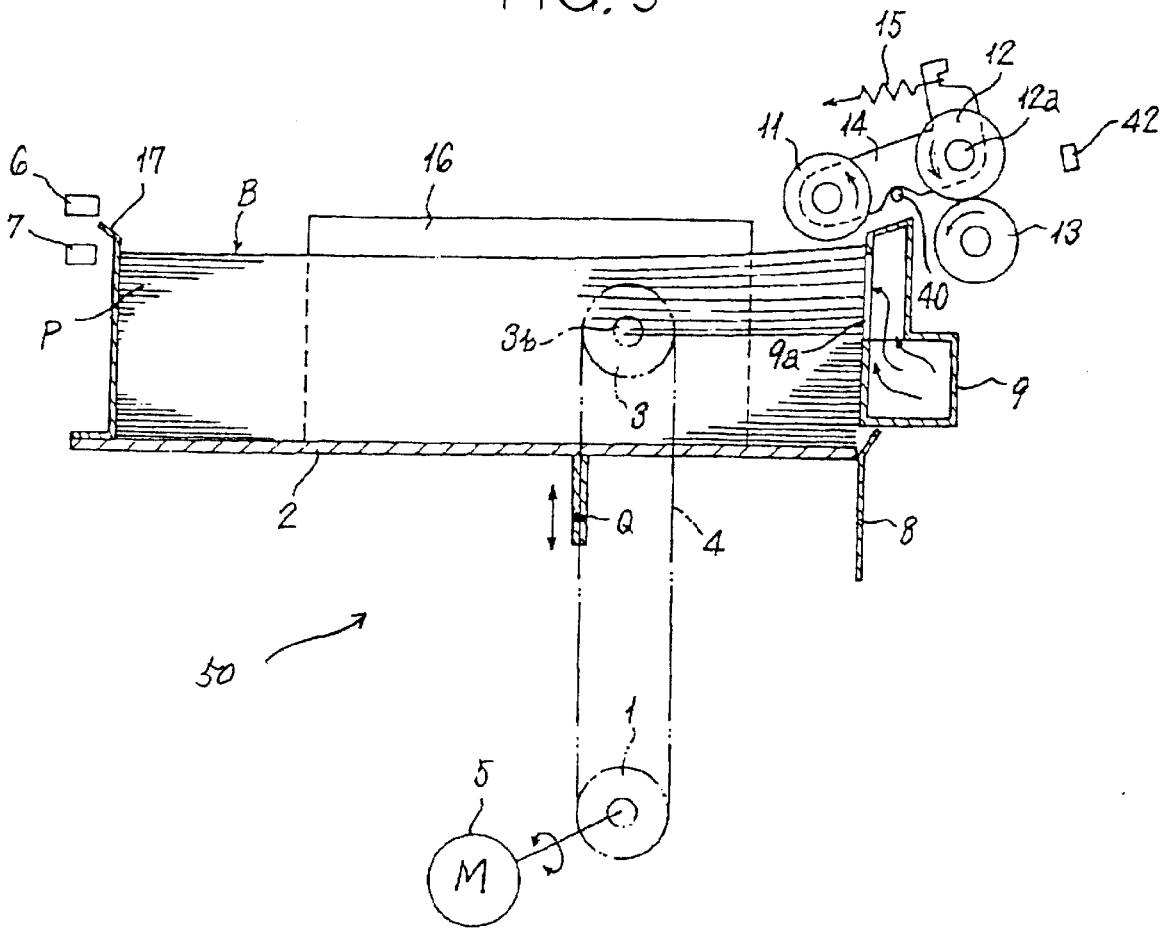

As shown in FIGS. 2 and 3, a pair of side fences (only one is visible) 16 are mounted on the tray 2 at opposite sides in the direction perpendicular to a direction of sheet feed V, i.e., in the direction of width of the paper sheets P. A back fence 17 is also mounted on the tray 2 upstream of the side fences 16 in the direction of sheet feed V. The side fences 16 and back fence 17 cooperate to position the stack of paper sheets P. Specifically, the side fences 16 are movable toward and away from each other in interlocked relation, the center of the tray 2 serving as a reference, so that they are adaptive to various sheet sizes.

Two sheet sensors 6 and 7 are mounted on a stationary member, not shown, at a preselected distance from each other in the up-and-down direction such that they face the back fence 17. The stationary member refers to an arm member affixed to the sidewalls, although not shown specifically. The sheet sensors 6 and 7 are responsive to the top paper sheet P on the tray 2. Specifically, the upper sheet sensor 6 senses the top paper sheet P located at a feeding position A where the pickup roller 11 can pay out the paper sheet P from the tray 2. The lower sheet sensor 7 senses the top sheet P located at a loosening position B where the paper sheet P faces an air chamber or loosening means 9. It is to be noted that at the loosening position B, the previously mentioned upper paper sheets P including the top paper sheet P face the air chamber 9.

In the illustrative embodiment, the motor 5, pulleys 1 and 3 and belts 4 constitute drive means. The drive means move the tray 2 upward to the feeding position A or downward to the loosening position B.

The outputs of the sheet sensors 6 and 7 are sent to the control means 41. Specifically, when the sensor 6 senses the top paper sheet P raised to the feeding position A by the tray 2, the upper sheet sensor 6 sends its output to the control means 41. In response, the control means 41 stops driving the motor 5. At this instant, the pickup roller 1 contacts the top paper sheet P under the action of the tension spring 15.

When the top paper sheet P is lowered to the loosening position B by the tray 2, the lower sheet sensor 7 sends its output to the control means 41. In response, the control means 41 also stops driving the motor 5. In this case, although the pickup roller 11 contacting the top paper sheet P moves downward together with the tray 2, the stop 40 stops the downward movement of the arm 14. As a result, when the top paper sheet P reaches the loosening position B, its upper surface has been released from the pickup roller 11. In this manner, in response to the outputs of the sheet sensors 6 and 7, the control means 41 controls the direction of rotation of the motor 5 and the start and stop of the rotation of the same.

Assume a range over which the tray 2 is movable up and down in an imaginary vertical plane containing the downstream end of the tray 2 in the direction of sheet feed V. Then, a positioning wall 8 is positioned in the lower portion of the above range. The air chamber 9 is positioned above the positioning wall 8 and therefore faces the downstream edges of the paper sheets P in the direction of sheet feed V. The positioning wall 8 and air chamber 9 serve as a reference for positioning the downstream edges of the paper sheets P.

Figure 4:
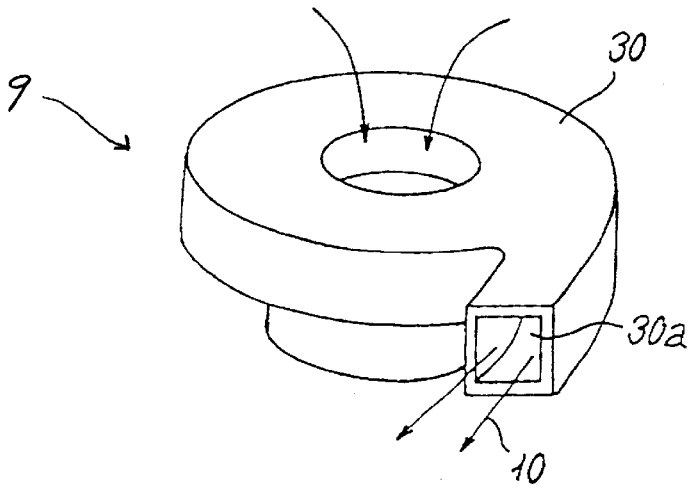
FIG. 4 is a perspective view of a blower included in the sheet feeder.

FIG. 4 shows a blower 30 having an air outlet 30*a*. The air chamber 9 is implemented as a box communicated to the air outlet 30*a* by a duct not shown. As shown in FIG. 2, the air chamber 9 has an inclined top 9*d* inclined upward from the left to the right. The inclined top 9*d* serves to guide the top paper sheet P being paid out by the pickup roller 11 toward the separating means.

Figure 5:
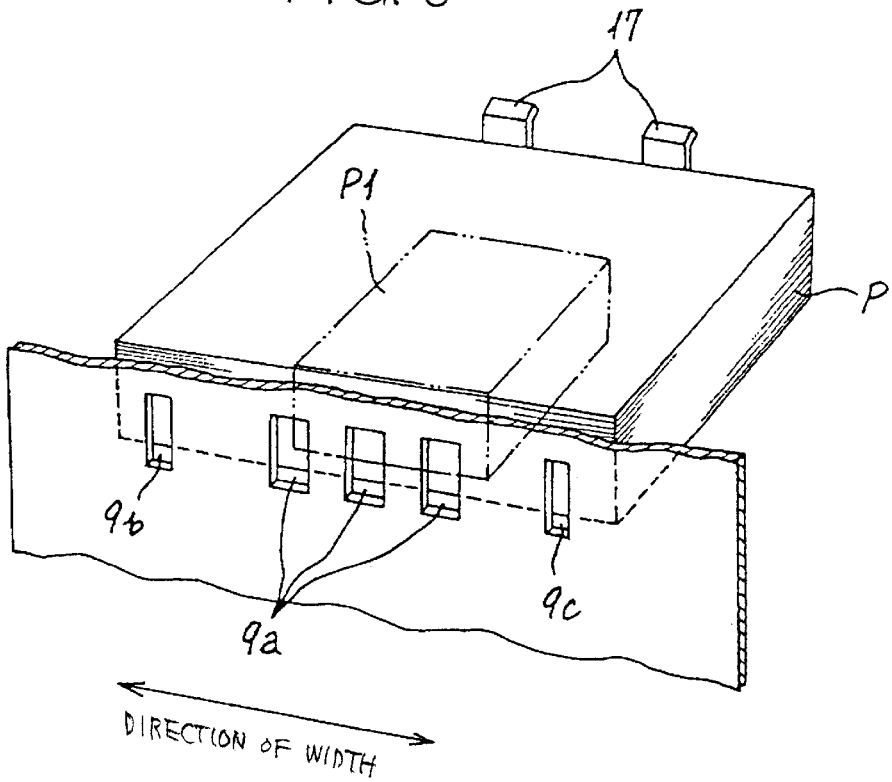
FIG. 5 is a perspective view showing a specific configuration of holes formed in a wall of an air chamber also included in the sheet feeder.
Figure 6:
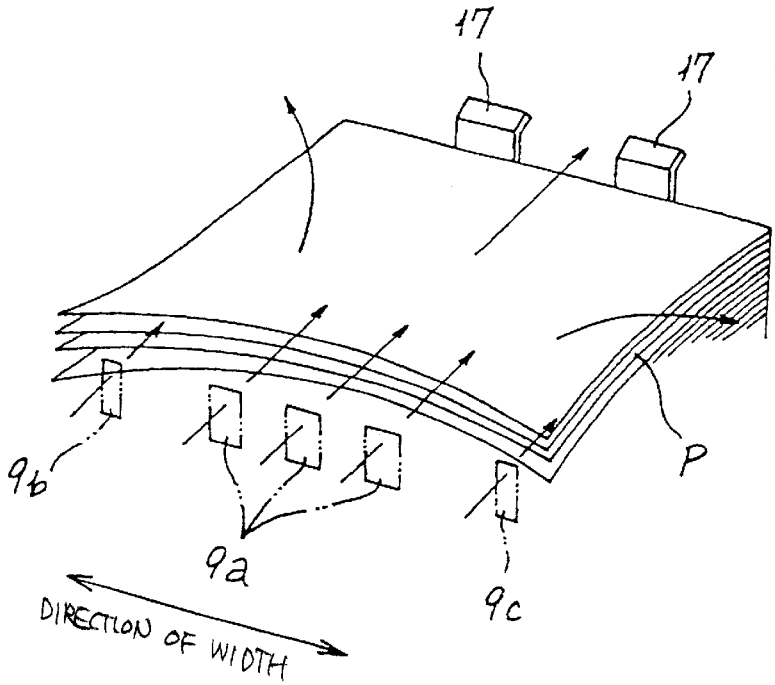
FIG. 6 is a view demonstrating how air sent via the holes of FIG. 5 loosens paper sheets.

The air chamber 9 includes a wall lying in the previously mentioned imaginary vertical plane and contacting the downstream edges of the paper sheets P stacked on the tray 2. As shown in FIGS. 5 and 6, first holes 9*a* and second holes 9*b* and 9*c* are formed in the above wall of the air chamber 9, so air delivered from the blower 30 to the air chamber 9 can be sent via the holes 9*a*, 9*b* and 9*c*. Specifically, three first holes 9*a* are positioned at the intermediate portion of paper sheets P of a large size in the direction of width of the sheets P. Two second holes 9*b* and 9*c* are positioned at both sides of the first holes 9*a* in the direction of width of the paper sheets P. The first holes 9*a* each are sized greater than the second holes 9*b* and 9*c*.

More specifically, the holes 9*a* through 9*c* face paper sheets P of a large size substantially over the entire width of such sheets P. Only the first or intermediate holes 9*a* face paper sheets P1 of a small size when such sheets P1 are positioned by the side fences 16 with respect to the center. The holes 9*a* therefore face both of sheets P of a large size and sheets P1 of a small size.

As shown in FIGS. 3 and 6, air delivered from the blower 30 to the air chamber 9 via the duct is sent toward the downstream edges of the paper sheets P via the holes 9*a* through 9*c*. The resulting air jet hits on the edges of the paper sheets P facing the holes 9*a* through 9*c* and thereby increases gaps between the paper sheets P. Consequently, the paper sheets P are loosened, i.e., an adhering force acting between nearby paper sheets P is reduced. This promotes not only the separation of plain paper sheets but also the separation of, e.g., coated paper sheets that are usually difficult to separate.

As shown in FIG. 3, assume that the paper sheets P of a large size are stacked on the tray 2, and that the top paper sheet P is located at the loosening position B to which the sheet sensor 7 is responsive. Then, the upper sheets P including the top sheet P face the holes 9*a* through 9*c*, so that the air jet concentrates on the upper sheets P and loosens them.

When the paper sheets P1 of a small size are stacked on the tray 2 alone, the air jet issuing via the holes 9*a* loosens the paper sheets P1. Although the air jet also issues via the other holes 9*b* and 9*c*, the holes 9*a* are greater in area than the holes 9*b* and 9*c*. It follows that a greater amount of air issues from the holes 9 than from the holes 9*b* and 9*c* and can desirably loosen even the paper sheets P1 of a small size that are difficult to loosen with a small amount of air. The paper sheets P1 of a large size can be desirably loosened by the amount of air issuing from all of the holes 9*a* through 9*c* covering the entire width of the sheets P1.

When the tray 2 rises from the position shown in FIG. 3, the pickup roller 11 also rises in contact with the top paper sheet P. When the tray 2 moves downward to locate the top paper sheet P at the loosening position B, the pickup roller 13 is spaced from the sheet P. As a result, a space for increasing the gaps between the paper sheets P is available above the top paper sheet P.

The operation of the sheet feeder 50 will be described more specifically hereinafter. When a main switch, not shown, provided on the copier shown in FIG. 1 is in an OFF state, the tray 2 is positioned such that the top paper sheet P is located at a preselected position below the loosening position B. When the main switch is turned on, the control means 41 starts rotating the motor 5 in order to raise the tray 2. As soon as the sheet sensor 7 senses the top paper sheet P, the control means 41 stops rotating the motor 5. At the same time, the control means 41 drives a blower motor (see FIG. 1) for driving the blower 30. As a result, an air jet is sent from the blower 30 to the upper paper sheets P via the air chamber 9 and holes 9*a* through 9*c*, loosening the upper paper sheets P before the feed of the sheets P.

On the elapse of a preselected period of time necessary for loosening the upper paper sheets P, the control means 41 stops driving the blower motor and starts driving the motor 5 so as to raise the tray 2. When the sensor 6 senses the top paper sheet P, the control means 41 stops driving the motor 5. In this condition, the control means 41 waits for a sheet feed signal.

When the control unit controlling the entire process of the copier sends a sheet feed signal to the control means 41, the control means 41 activates a feed roller drive source assigned to the feed roller 12. Consequently, the feed roller 12 and therefore the pickup roller 11 and separator roller 13 operatively connected thereto start rotating. While the pickup roller 11 is expected to pay out only the top paper sheet P from the tray 2, it sometimes pays out some paper sheets P underlying the top paper sheet P together with the top paper sheet P due to friction.

When the top paper sheet P or the upper paper sheet P including it are fed to the nip between the feed roller 12 and the separator roller 13, the rollers 12 and 13 cooperate to separate the top paper sheet P from the underlying paper sheets P and convey it in the direction of sheet feed V. When the sensor 42 senses the leading edge of the paper sheet P so conveyed, it sends its output to the control means 41. In response, the control means 41 drives the motor 5 in order to lower the tray 2 until the sheet sensor 7 senses the paper sheet P now present on the top of the stack. In response to the resulting output of the sheet sensor 7, the control means 41 again stops driving the motor 5. At this instant, the paper sheet P conveyed by the feed roller 12 and separator roller 13 still remains nipped between the rollers 12 and 13. However, the trailing edge of this sheet P is prevented from being dislocated because the stroke of the tray 2 in the up-and-down direction is small.

When the sheet sensor 7 again senses the top sheet on the tray 2, the control means 41 stops driving the motor 5 and starts driving the blower motor. As a result, an air jet is sent from the blower 30 for loosening the upper paper sheets P. The operation described above is repeated thereafter.

The illustrative embodiment moves the tray 2 up and down every time the sensor 42 senses the paper sheet P, i.e., every time one paper sheet P is paid out. Alternatively, any other desired number may be set in a sheet counter included in the control means 1 in order to move the tray 2 every time a desired number of paper sheets are paid out.

The loosening degree of the paper sheets P depends on the amount and pressure of the air jet as well as the velocity of the same. Also, the optimal loosening degree depends on the kind of paper sheets P, e.g., plain paper sheets or coated paper sheets, the sheet size, e.g., A4 or A3, and the position of paper sheets P on the tray 2, e.g., a profile position or a landscape position. The amount, pressure and velocity of air may therefore be adjusted in accordance with such factors, or the loosening means itself may be held inoperative. When the loosening means is held inoperative, none of the motor 5, tray 2 and blower 30 is driven. This is successful to reduce the sheet feed time and to obviate noise ascribable to the blower 30.

If desired, a throttle valve may be positioned in the duct communicating the blower 30 to the air chamber 9 as means for adjusting the loosening ability of the loosening means. With the throttle valve, it is possible to adjust the loosening degree in accordance with the characteristic or the condition of the paper sheets P. Alternatively, the rotation speed of the blower motor, FIG. 1, may be varied to vary the amount, pressure and velocity of air to be sent from the blower 30. Such schemes allow the paper sheets P to be desirably loosened in matching relation to the characteristic or the condition thereof.

As stated above, the illustrative embodiment achieves various unprecedented advantages, as enumerated below.

(1) In a sheet feeder of the type including a tray movable up and down with paper sheets stacked thereon, even if friction roller means for paying out the sheets one by one is arranged to contact the top sheet, the top sheet is displaceable. This, coupled with loosening means for reducing an adhering force acting between nearby paper sheets, promotes the separation of nearby sheets with a simple configuration. As a result, the paper sheets are prevented from being fed together or from being not fed at all and can therefore be fed one by one at a high speed.

(2) The adhering force acting between upper paper sheets, which are about to be paid out, is reduced.

(3) Drive means easily implements switching between a feeding position and a loosening position, i.e., a condition wherein the friction roller means functions and a condition wherein the loosening means functions. It is therefore possible to surely loosen and convey the paper sheets.

(4) The top paper sheet is displaced once for every paper sheet or every preselected number of paper sheets in accordance with the characteristic of the sheets. When the top paper sheet is displaced once for a preselected number of paper sheets, it is possible to reduce the number of times of loosening and therefore to extend the life of parts constituting the drive means.

(5) A smaller amount of air is sent from holes assigned to paper sheets of a large size than from holes assigned to both of paper sheets of a small size and paper sheets of a large size. Therefore, a greater amount of air is available for loosening paper sheets of a small size than for loosening paper sheets of a large size, so sheets of a smallest size can be efficiently loosened. In addition, the entire amount of air issuing from all of the holes is available for efficiently loosening paper sheets of a large size.

(6) The loosening ability is adequately variable in accordance with the characteristic or the condition of paper sheets. This optimizes the separation of paper sheets and allows, when paper sheets of the kind not needing air are used, allows the copying speed to be increased and obviates noise ascribable to a blower.

(7) Even paper sheets that are difficult to separate can be surely fed without any jam or simultaneous feed of multiple sheets by enhancing the separating ability.

Figure 7:
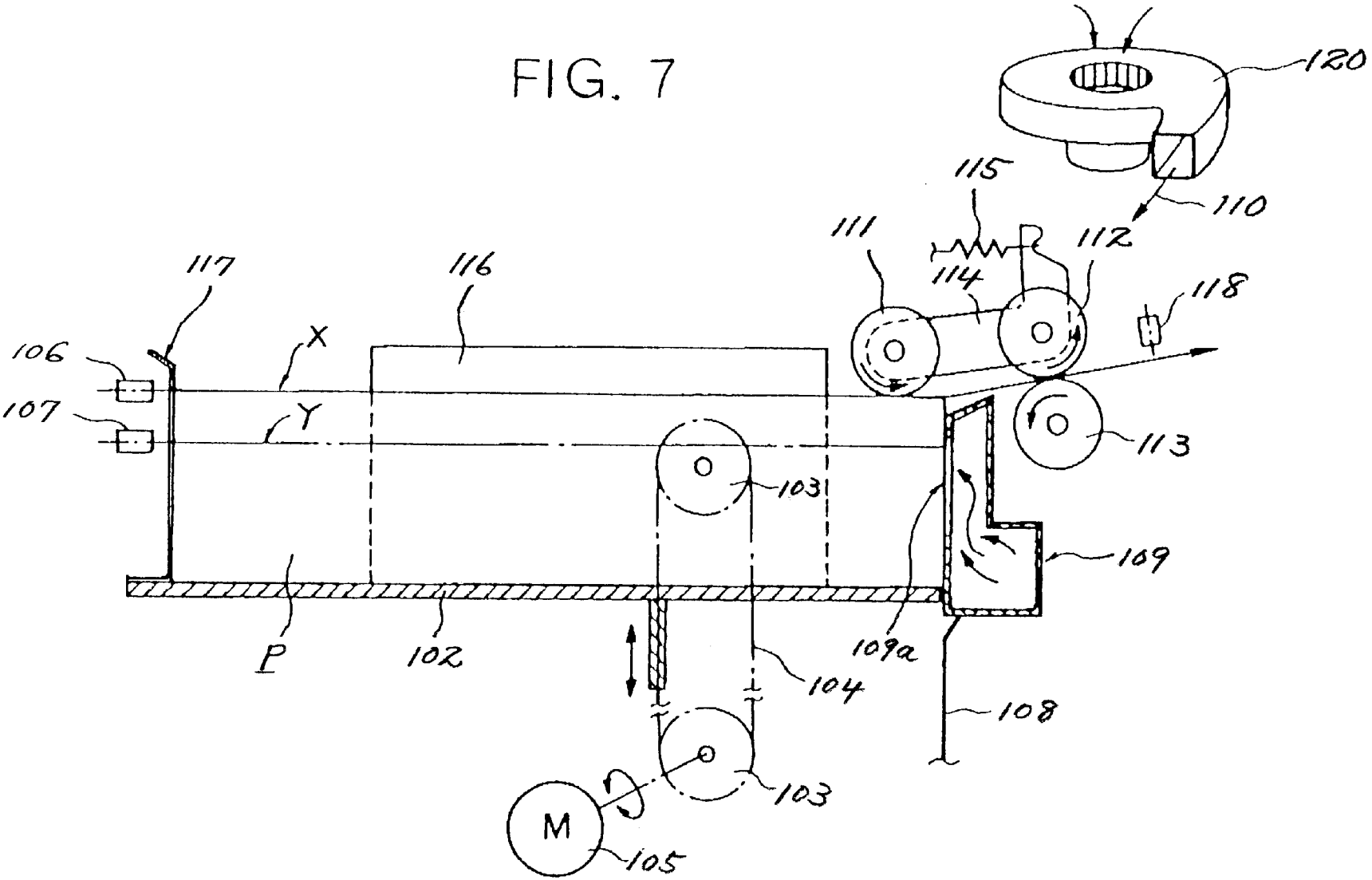
FIG. 7 is a view showing an alternative embodiment of the present invention.

Referring to FIG. 7, an alternative embodiment of the present invention will be described. As shown, the sheet feeder includes a tray 102 loaded with a stack of paper sheets P. An elevation motor 105 allows the tray 102 to move up and down via a pair of pulleys 103 and a belt 104 passed over the pulleys. Another pair of pulleys 103 and another belt 104 (not visible) are provided as in the previous embodiment.

An upper sheet sensor 106 is responsive to an upper limit level X assigned to the top of the paper sheets P stacked on the tray 102. The top paper sheet P is usually positioned at the upper limit level X. A lower sheet sensor 107 is responsive to a lower limit level Y also assigned to the top of the paper sheets P.

A positioning wall 108 and an air chamber 109 are located in the vicinity of the tray 102, as in the previous embodiment. A pickup roller 111 formed of rubber or similar high friction material contacts the leading edge portion of the top paper sheet P in the direction of sheet feed. A feed roller 12 and a separator roller 113 are located downstream of the pickup roller 111 in the direction of sheet feed for separating and conveying the top paper sheet P in cooperation.

The pickup roller 111 is mounted on an arm 114 and constantly biased counterclockwise by a tension spring 115. When the tray 101 moves upward, the pickup roller 111 also moves upward in contact with the top paper sheet P. When the tray 102 moves downward until the lower sheet sensor 107 senses the top paper sheet P, the pickup roller 111 is spaced from the sheet P.

A pair of side fences 116 are mounted on the tray 102 at opposite sides in the direction of width of the paper sheets P, as in the previous embodiment. Likewise, a back fence 117 is mounted on the rear end of the tray P. The side fences 116 and back fence 117 cooperate to position the paper sheets P on the tray 102. A sensor 118 is positioned downstream of the feed roller 112 in the direction of sheet feed in order to sense the leading edge of the paper sheet P being conveyed toward a registration roller pair not shown.

A blower 120 is communicated to the air chamber 109 by a duct not shown. The blower 120 delivers air 110 to the air chamber 109. As a result, an air jet, also labeled 110, is sent toward the end of the sheet stack P via first holes 109*a* formed in one wall of the air chamber 109 facing the sheet stack P, thereby reducing an adhering force acting between nearby paper sheets P.

Figure 8:
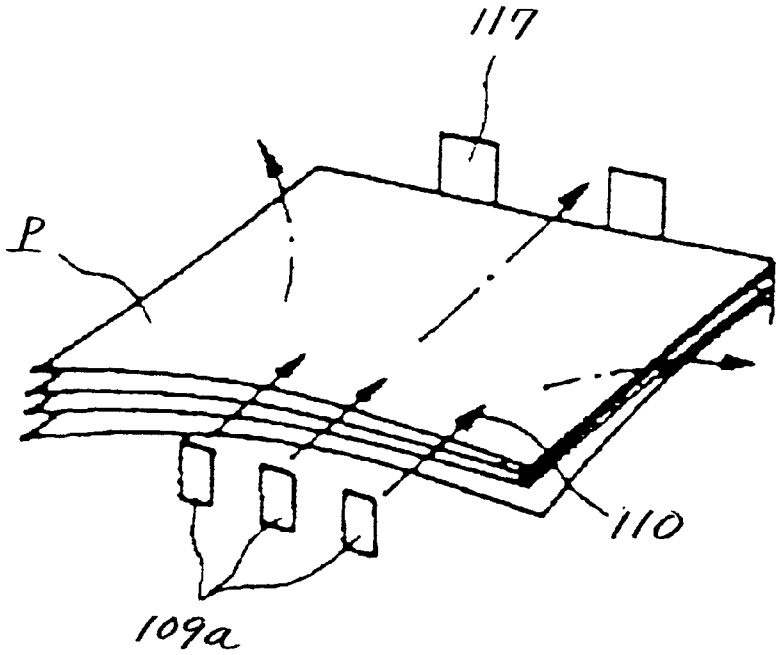
FIG. 8 is a view demonstrating how air loosens paper sheets in the alternative embodiment.

As shown in FIG. 8, when the top paper sheet P on the tray 102 is positioned at the lower limit level Y to which the lower sheet sensor 107 is responsive, the air jet 110 hits against the edges of the previously mentioned upper paper sheets P and loosens them.

Figure 9:
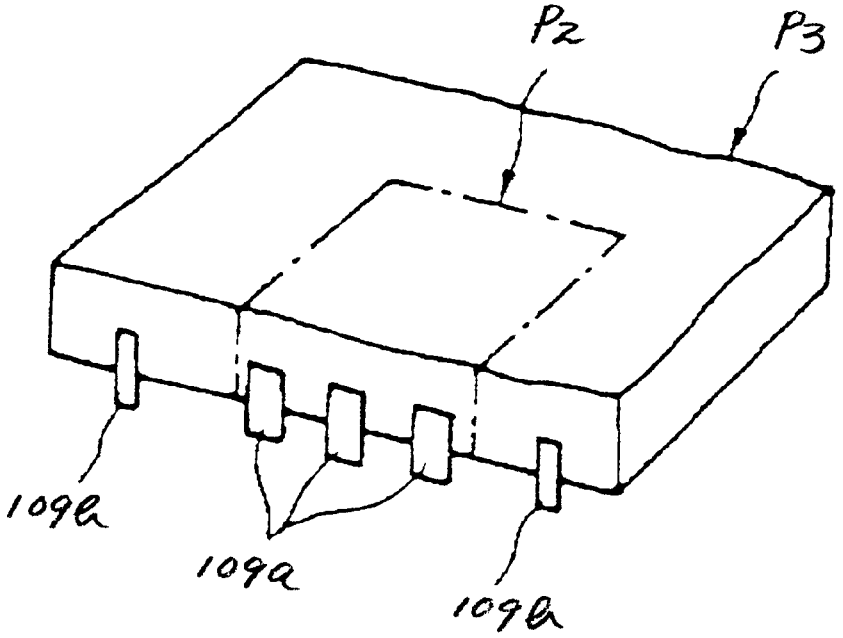
FIG. 9 is a view showing a specific arrangement of holes included in the alternative embodiment.

FIG. 9 shows the first holes 109*a* and second holes 109*b* formed in the wall of the air chamber 109 specifically. As shown, a plurality of (three in the illustrative embodiment) first holes 109*a* are assigned to paper sheets P2 of a small size. Two second holes 109*b* are positioned at both sides of the holes 109*a* and assigned to paper sheets P3 of a large size. The first holes 109*a* should preferably have a greater total area than the second holes 109*b* in order to promote efficient loosening of the paper sheets.

In the sheet feeder shown in FIG. 7, the pickup roller 111 sequentially pays out the paper sheets P one by one, the top paper sheet P being first. The feed roller 112 and separator roller 113 separate the top paper sheet P from the under lying paper sheets P and convey it to the downstream side. At this instant, the air jet 110 also contributes to the separation of the sheets P.

Figure 10:
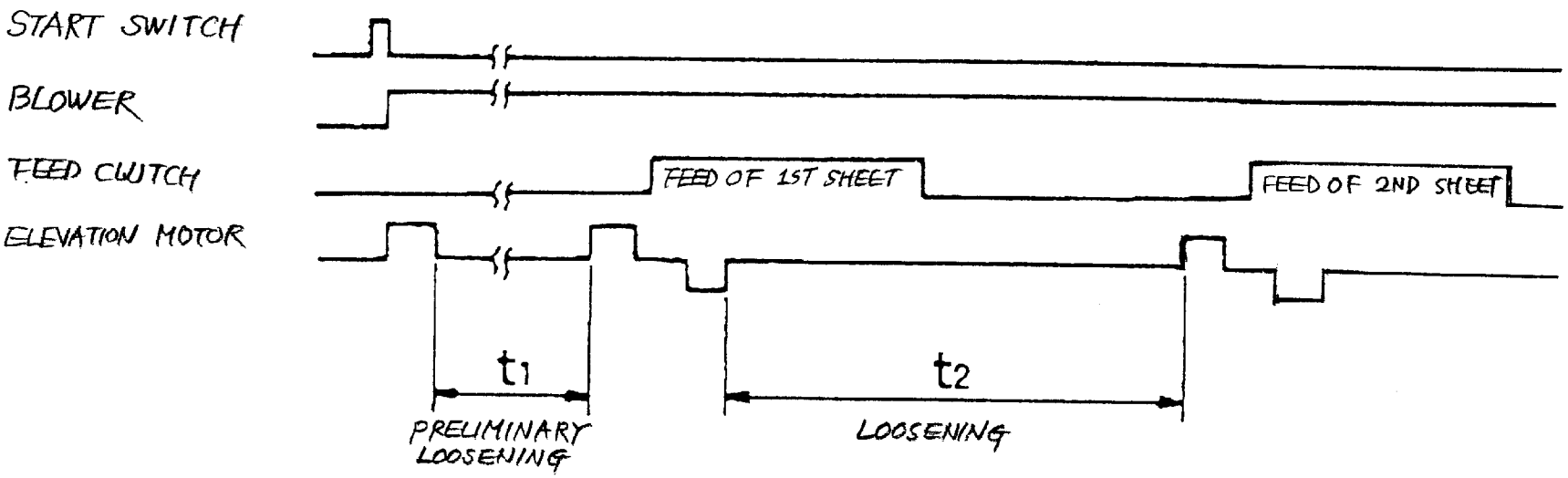
FIG. 10 is a timing chart representative of a specific operation of a blower also included in the alternative embodiment.

Reference will be made to FIG. 10 for describing a specific timing at which the blower 120 delivers air to the air chamber 109. When a start switch, not shown, provided on the copier is pressed, the blower 120 is driven to deliver air 110 to the air chamber 109 before sheet feed. The resulting air jet 110 is sent from the air chamber 109 via the holes 109*a* and 109*b*. At the same time, the elevation motor 105 is driven to raise the top paper sheet P on the tray 102 until the lower sheet sensor 107 senses the sheet P. Consequently, the air jet 110 continuously loosens the upper paper sheets P for a preselected period of time t1 (preliminary loosening time).

On the elapse of the preliminary loosening time t1, the elevation motor 105 is again driven to raise the top paper sheet P until the upper sheet sensor 106 senses the sheet P. The pickup roller 111 then contacts the top paper sheet P. Subsequently, a feed clutch, not shown, is coupled to rotate the pickup roller 111 with the result that the top paper sheet or first paper sheet P is paid out from the tray 102. When the sensor 118 senses the leading edge of the sheet P paid out, the elevation motor 105 is reversed to lower the tray 102 until the lower sheets sensor 107 senses the top of the sheet stack. As a result, the upper paper sheets P on the tray 102 are again loosened for another preselected period of time t2 (usual loosening time). The procedure described above is repeated thereafter.

The preliminary loosening time t1 is significant because the upper paper sheets P to be paid out first are loosened less than the lower paper sheets P that are repeatedly loosened. The preliminary loosening time 1 is selected to be longer than the usual loosening time t2. Alternatively,, the amount, pressure and velocity of the air jet 110 may be increased during preliminary loosening, compared to the usual loosening.

The tray 102 may be moved up and down once for a plurality of paper sheets P fed, if desired. Also, the amount, pressure and velocity of the air jet 110 may be suitably varied in accordance with, e.g., the kind, size and orientation of the paper sheets P.

As stated above, when the start switch is pressed, the tray 102 is raised until the top paper sheet P reaches the lower limit level Y. The blower 120 then sends the air jet 110 toward the upper paper sheets P existing on the tray 102 (preliminary loosening). Subsequently, the tray 102 is raised until the top paper sheet P reaches the upper limit level X, so that the sheet P is paid out from the tray 102. It follows that the adhering force acting between the upper paper sheets P is reduced and allows the sheets P to be easily separated without multiple feed or feed failure.

In summary, the alternative embodiment described with reference to FIGS. 7 through 10 has various advantages, as enumerated below.

(1) Before feeding means feeds a paper sheet, loosening means sends air toward the front end of a sheet stack in order to execute preliminary loosening. This enhances reliable loosening of paper sheets and thereby obviates the simultaneous feed of multiple sheets and feed failure.

(2) A longer period of time is allocated to the preliminary loosening than to usual loosening, further enhancing reliable loosening.

(3) At least one of the velocity, amount and pressure of air for loosening the paper sheets is greater during preliminary loosening than during usual loosening, also further enhancing reliable loosening.

(4) The loosening ability of the loosening means is variable in accordance with the kind and size of the paper sheets used. The loosening means can therefore surely loosen the paper sheets in matching relation to such factors of the sheets.

Various modifications will become possible for those skilled in the art after receiving the teachings of the present disclosure without departing from the scope thereof.

What is claimed is:

1. A sheet feeder for sequentially feeding paper sheets stacked on a tray one by one toward a preselected position while separating said paper sheets with separating means, said sheet feeder comprising:

friction roller means for conveying, among the paper sheets stacked on the tray, upper paper sheets including a top paper sheet toward the separating means; and loosening means facing leading edges of the paper sheets in a direction of sheet feed for loosing said paper sheets by sending air toward said leading edges;

wherein the top paper sheet on the tray is movable between a feeding position where said friction roller means is capable of conveying said top paper sheet and a loosening position where said loosening means faces the leading edges of the paper sheets.

2. A sheet feeder as claimed in claim 1, wherein at said loosening position the upper paper sheets including the top paper sheet face said loosening means.

3. A sheet feeder as claimed in claim 2, further comprising drive means for causing the tray to move in an up-and-down direction to thereby move the top paper sheet between said feeding position and said loosening position.

4. A sheet feeder as claimed in claim 3, further comprising control means for causing the top paper sheet to move between said feeding position and said loosening position once for a single paper sheet fed or a plurality of paper sheets fed.

5. A sheet feeder as claimed in claim 4, wherein said sheet feeder is capable of accommodating sheets of different sizes, said loosening means including a plurality of first holes capable of sending air toward both of sheets of a small size and sheets of a large size and a plurality of second holes capable of sensing air only toward sheets of a large size, said plurality of first holes being greater in size than said plurality of second holes.

6. A sheet feeder as claimed in claim 5, wherein said loosening means has a loosening ability variable in accordance with a kind and a size of the paper sheets.

7. A sheet feeder as claimed in claim 1, further comprising drive means for causing the tray to move in an up-and-down direction to thereby move the top paper sheet between said feeding position and said loosening position.

8. A sheet feeder as claimed in claim 1, further comprising control means for causing the top paper sheet to move between said feeding position and said loosening position once for a single paper sheet fed or a plurality of paper sheets fed.

9. A sheet feeder as claimed in claim 1, wherein said sheet feeder is capable of accommodating paper sheets of different sizes, said loosening means including a plurality of first holes capable of sending air toward both of paper sheets of a small size and paper sheets of a large size and a plurality of second holes capable of sensing air only toward the sheets of a large size, said plurality of first holes being greater in size than said plurality of second holes.

10. A sheet feeder as claimed in claim 1, wherein said loosening means has a loosening ability variable in accordance with a kind and a size of the paper sheets.

11. In an image forming apparatus including an image forming section for transferring a toner image to a paper sheet fed from a sheet feeder, said sheet feeder comprises:

friction roller means for conveying, among paper sheets stacked on a tray, upper paper sheets including a top paper sheet toward separating means to thereby separate said top paper sheet from underlying paper sheets and convey said top paper sheet toward the image forming section; and loosening means facing leading edges of the paper sheets in a direction of sheet feed for loosing said paper sheets by sending air toward said leading edges;

wherein the top paper sheet on the tray is movable between a feeding position where said friction roller means is capable of conveying said top paper sheet and a loosening position where said loosening means faces the leading edges of the paper sheets.

* * * * *